US011072898B2

(12) United States Patent
Wang et al.

(10) Patent No.: US 11,072,898 B2
(45) Date of Patent: Jul. 27, 2021

(54) COMBINED ENERGY DISSIPATION SCAFFOLDING STRUCTURE FOR PREVENTING FALLING ROCK FOR HIGH AND STEEP SLOPE IN SEISMIC REGION

(71) Applicant: Dalian University of Technology, Dalian (CN)

(72) Inventors: Zhengzheng Wang, Dalian (CN); Changan Zhu, Dalian (CN); Yang Gao, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 455 days.

(21) Appl. No.: 16/088,555

(22) PCT Filed: Dec. 17, 2016

(86) PCT No.: PCT/CN2016/110554
§ 371 (c)(1),
(2) Date: Sep. 26, 2018

(87) PCT Pub. No.: WO2018/098857
PCT Pub. Date: Jun. 7, 2018

(65) Prior Publication Data

US 2019/0177932 A1 Jun. 13, 2019

(30) Foreign Application Priority Data

Dec. 2, 2016 (CN) ..... 201611100173.6

(51) Int. Cl.
*E01F 7/04* (2006.01)

(52) U.S. Cl.
CPC ..... *E01F 7/045* (2013.01)

(58) Field of Classification Search
CPC ..... E01F 7/04; E01F 7/045
See application file for complete search history.

(56) References Cited

U.S. PATENT DOCUMENTS 3,187,852 A * 6/1965 Carman ..... E04B 1/3205 52/245
3,282,056 A * 11/1966 Fisher ..... E01D 19/02 405/286

(Continued)

FOREIGN PATENT DOCUMENTS

CN 201330361 Y 10/2009
CN 101974886 A 2/2011

(Continued)

OTHER PUBLICATIONS

International Search Report Based on Chinese Application PCT/CN2016/110554; dated Mar. 29, 2017.

(Continued)

*Primary Examiner* — Matthew R McMahon
(74) *Attorney, Agent, or Firm* — Muncy, Geissler, Olds & Lowe, P.C.

(57) ABSTRACT

A combined energy dissipation scaffolding structure for preventing falling rock hazards for high and steep side slope during highway construction. The combined energy dissipation scaffolding structure mainly comprises five parts: a top surface impact-resistance system closely jointed with the existing slope surface, a top surface support system composed of 3D stereographic steel frame systems, a scaffolding body structure composed of a cross beam and support steel-pipe posts at both sides, a mountain-side anchorage system for anchoring the top surface impact-resistance system and the scaffolding body structure, and an anchoring-type steel-plate concrete composite foundation, wherein a fixed base is welded with the bottom of the steel-pipe post and is driven in the foundation soils using anchor rods. Compared with the traditional shed tunnel structure, the combined energy dissipation scaffolding structure has the advantage that the construction time is greatly reduced, (Continued)

thereby being beneficial to making road unblocked and improving anti-disaster capability.

2 Claims, 2 Drawing Sheets

(56) References Cited

U.S. PATENT DOCUMENTS 4,211,504 A * 7/1980 Sivachenko ..... E01D 19/125
405/124
5,252,002 A * 10/1993 Day ..... E01F 5/005
405/124

FOREIGN PATENT DOCUMENTS

| | | | | |
|---|---|---|---|---|
| CN | 103510476 | A | 1/2014 | |
| CN | 204311364 | U | 5/2015 | |
| FR | 2381865 | A1 * | 9/1978 | ..... E01F 7/045 |
| FR | 3081891 | A1 * | 12/2019 | ..... E01F 7/045 |
| JP | H0734418 | A | 2/1995 | |
| KR | 20100071377 | A | 6/2010 | |

OTHER PUBLICATIONS

Written Opinion Based on Chinese Application PCT/CN2016/110554; dated Mar. 29, 2017.

* cited by examiner

COMBINED ENERGY DISSIPATION SCAFFOLDING STRUCTURE FOR PREVENTING FALLING ROCK FOR HIGH AND STEEP SLOPE IN SEISMIC REGION

TECHNICAL FIELD

The present invention relates to a scaffolding structure for preventing falling rock hazards for high and steep slope during highway construction, which is particularly suitable for the prevention and cure against highway disaster and post-disaster reconstruction engineering in the earthquake area.

BACKGROUND

Highway construction in China is in the rapid development stage. In recent years, China has invested more and more money in western China. However, because the landform of western China is extremely complicated, many traffic routes are inevitably located between valleys and hills, and dangerous crag falling rock at high and steep slope causes serious potential safety hazards to road traffic. Meanwhile, since China is an earthquake-prone country, phenomena such as side slope rock soil mass destabilization, collapse, landslide and the like caused by earthquake frequently occur, causing great damage to transport, and life and property.

To guarantee traffic safety, reinforced concrete shed tunnel structures are often used in engineering construction. The traditional reinforced concrete shed tunnel structure has the disadvantages of long construction period, high building cost, great interference of construction to transport and use of sandy soil as a buffer material. It is proved by the fact that the sandy soil bed course not only has a poor energy dissipation effect, but also has a strong impact on the stability of the shed tunnel structure because of relatively large dead-weight.

SUMMARY

The present invention aims to solve the technical problem about how to provide a combined energy dissipation structure which not only can prevent damage to highway construction caused by dangerous crag falling rock under the geological condition at high and steep slope in a seismic region, but also can effectively improve the stability of the scaffolding and can be quickly erected to make road unblocked.

The present invention has the following technical solution:

A combined energy dissipation scaffolding structure for preventing falling rock for high and steep slope in a seismic region, comprising a top surface impact-resistance system, a top surface support system, a scaffolding body structure, a mountain-side anchorage system, and an anchoring-type steel-plate concrete composite foundation.

wherein the top surface impact-resistance system comprises an upper-layer steel plate, a lower-layer steel plate and an EPE impact-resistance seismic-decrease layer, wherein the upper-layer steel plate is made of a corrugated steel plate, the lower-layer steel plate is made of a flat steel plate, the EPE impact-resistance seismic-decrease layer is filled between the upper-layer steel plate and the lower-layer steel plate, and the steel plates are connected using high-strength bolts; according to the test result, the impact-resistance capacity of the corrugated steel plate is greatly higher than that of the flat steel plate under the same index, so that the corrugated steel plate adopted by the upper-layer head-on impact surface of the top surface is more beneficial to improving the anti-disaster capacity of the scaffolding.

The top surface support system is composed of 3D stereographic steel frame systems formed by combination in a horizontal direction, a vertical direction, a slant direction and a longitudinal direction, and the top surface support system is welded with the top surface impact-resistance system and the scaffolding body structure respectively, thereby improving the stability of the structure and enhancing the bearing capacity of the structure.

The scaffolding body structure is composed of an I-shape steel cross beam and support steel-pipe posts at both sides, concrete in ⅓-½ height is cast at the lower-middle part of each steel-pipe post to improve the stability of the steel-pipe post; on the one hand, the center of gravity thereof is reduced as far as possible, and on the other hand, the inertia force of the steel pipe due to seismic load is reduced. The upper part of the mountain-side steel-pipe post of the scaffolding body structure is provided with an impact prevention steel plate, and the lower part thereof is provided with a movable steel plate, to periodically clean mountain-side falling rock and elastic rock, the impact prevention steel plate is anchored to the side slope by a horizontal anchor rod, thereby reinforcing the steel pipe posts, to guarantee the stability of the scaffolding body structure. The I-shape steel cross beam is connected to the steel-pipe posts at both sides by an isolation bearing, to cooperate with the EPE impact-resistance seismic-decrease layer in the top surface impact-resistance system to achieve the functions of seismic decrease and energy dissipation of the present invention.

The mountain-side anchorage system is composed of the feet-lock anchor rod which is perpendicular to the rock mass joint structure plane, and the feet-lock anchor rod is connected to the top surface impact-resistance system and the scaffolding body structure respectively; on the one hand, the slippage and collapse of mountain-side soil-rock mass can be prevented; and one the other hand, the integrality of the top surface impact-resistance system and the scaffolding body structure is enhanced, so that the stability is improved.

The anchoring-type steel-plate concrete composite foundation is manually or mechanically excavated to form a foundation pit depending on site geological and topographical conditions, and is connected to the scaffolding body structure by a fixed base, wherein the base is welded with the steel-pipe posts using a steel plate, and the steel plate is connected to the concrete foundation using an anchor rod to improve the bearing capacity of the structure.

The present invention has the beneficial effect that by arranging a combined scaffolding structure, the present invention not only can prevent potential safety hazards caused by dangerous crag falling rock at high and steep slope in a seismic region to highway construction and vehicle travelling, but also can effectively improve the stability and anti-seismic capability of scaffolding structures, so that the integrality, security and durability of the structure thereof are significantly improved.

Figure 1:
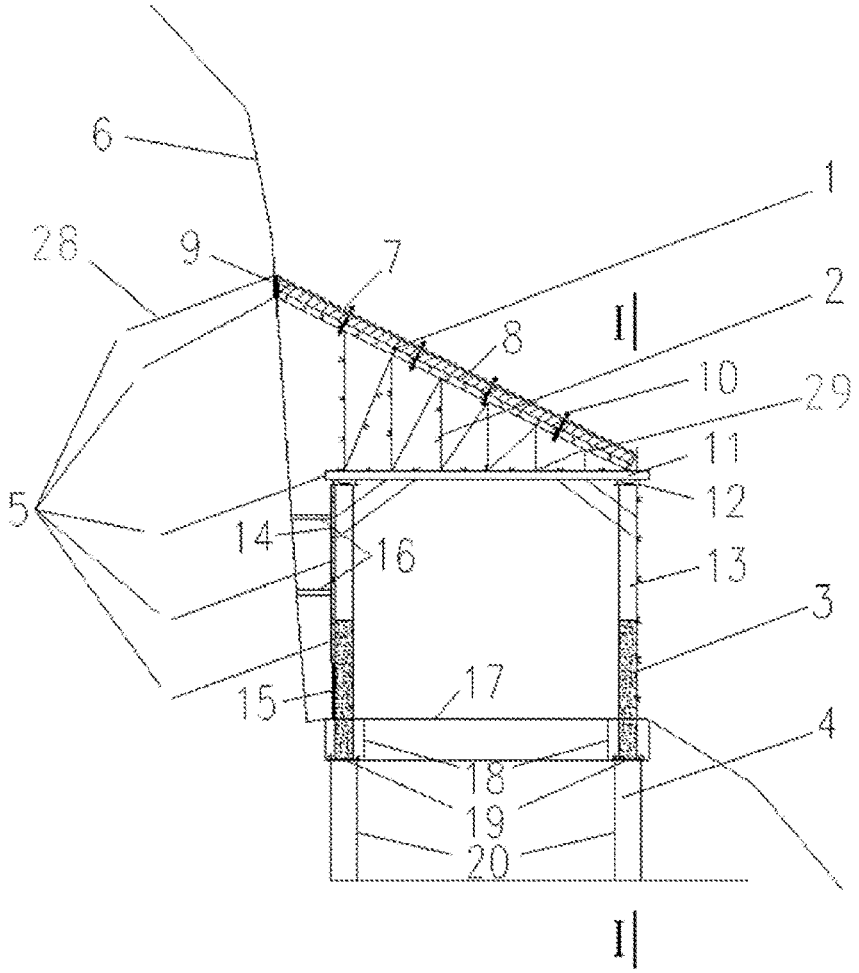
FIG. 1 is a cross-section view of a steel scaffolding.
Figure 2:
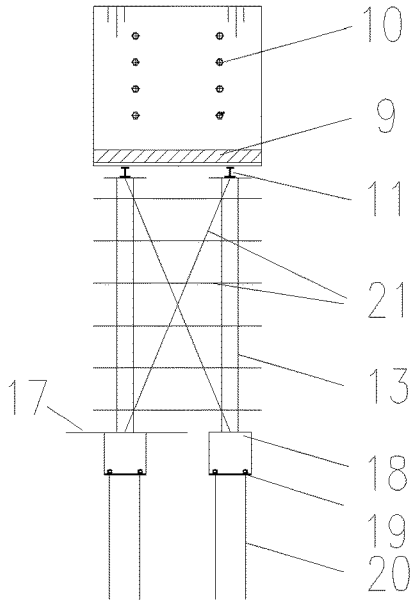
FIG. 2 is a side view of I-I.
Figure 3:
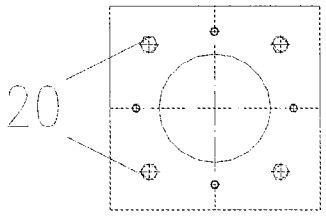
FIG. 3 is a diagram of a steel plate at the bottom of a steel pipe.
Figure 4:
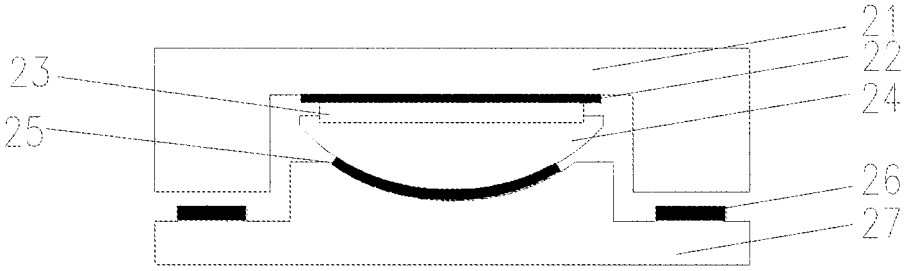
FIG. 4 is a diagram of an isolation bearing.

Legends: 1. top surface impact-resistance system; 2. top surface support system; 3. scaffolding body structure; 4. anchoring-type steel-plate concrete composite foundation; 5. mountain-side anchorage system; 6. existing slope surface; 7. upper-layer steel plate; 8. lower-layer steel plate; 9. EPE impact-resistance seismic-decrease layer; 10. high-strength bolt; 11. I-shape steel cross beam; 12. isolation bearing; 13. steel pipe post; 14. impact-resistance steel plate; 15. movable steel plate; 16. horizontal anchor rod; 17. existing road surface; 18. excavated foundation pit; 19. fixed base; 20. anchor rod; 21. upper support plate; 22. stainless steel plate; 23. PTFE circular plate; 24. support ball core; 25. PTFE spheroidal plate; 26 rubber sealing ring; 27. lower support plate; 28. feet-lock anchor rod; 29. channel steel.

DETAILED DESCRIPTION

Specific embodiments of the present invention are described below in detail in combination with the technical solution and accompanying drawings.

Embodiment

1. Top Surface Impact-Resistance System

The top surface impact-resistance system 1 is composed of two layers of steel plates and an Expanded Polyethylene impact-resistance seismic-decrease layer, wherein the upper-layer steel plate 7 is made of a corrugated steel plate with the thickness of 10 mm, wave height of 55 mm and pitch of waves of 200 mm, the lower-layer steel plate 8 is made of an ordinary flat steel plate with the thickness of 5 mm, the EPE impact-resistance seismic-decrease layer 9 with the thickness of 30 cm is filled between the two layers of steel plates, wherein the density thereof is greater than 23 kg/m$^3$, the two layers of steel plates are connected using high-strength bolts 10, the inter-row spacing being 2×2 m. The mountain-side scaffolding tope corrugated steel plate is required to extend to the existing slope surface, so that the corrugated steel pipe is closely joined with the slope surface, and the corrugated steel plate is paved along the top surface slope according to the wave trough.

2. Top Surface Support System

A steel frame support system is formed by the top surface support system through I beams and channel beams at different angles, and all components are welded and need anti-corrosion de-rusting. Channel beams are erected between the top surface support system 2 and the top surface impact-resistance system 1 along the top surface slope and are spaced at 50 cm, the top surface support system 2 is connected to the top surface impact-resistance system 1 by high-strength bolts 10, and the angle of the top surface slope is comprehensively determined according to the size of falling rock impact energy.

3. Mountain-Side Anchorage System

The mountain-side anchorage system 3 is connected to the top surface impact-resistance system 1 and the scaffolding body structure 4 respectively by five feet-lock anchor rods which are perpendicular to the rock mass joint structure plane. Two feet-lock anchor rods at the upper side are connected to the top surface impact-resistance system 1, have the length of 4 m and are made of twisted steel of φ32; and three foot-lock anchor rods at the lower side are connected to the scaffolding body structure 4, have the length of 4.5 m and are made of twisted steel of φ32.

4. Scaffolding Body Structure

The scaffolding body structure 4 is flexibly adjusted according to site conditions by taking 4 m as one unit, off-site machined and transported to site for installation, and all units are two-sided welded into a whole using steel section. The cross section of the body structure is composed of a 25b H-shape steel cross beam 11 and steel pipe posts 13 of φ426 mm, a seismic-decrease support 12 is disposed between the I-shape steel cross beam 11 and the steel pipe posts 13, wherein C15 concrete is poured at the bottom of each steel pipe post, and the top thereof is capped by a steel plate of 0.6×0.6 m, the thickness being 16 mm. The steel pipe posts 13 are longitudinally spaced at the centerline distance of two steel pipes of 2.5 m, and are connected by channel beams 21 in the vertical direction and slant direction of 45°. The upper part of the mountain-side steel pipe post is provided with an impact prevention steel plate 14 of 5 mm, the lower part thereof is provided with a movable steel plate 15, and the two steel plates are connected by bolts to facilitate cleaning. The steel pipe post is close to the existing slope surface section, and a horizontal anchor rod 16 is disposed to reinforce the steel pipe post.

5. Anchoring-Type Steel-Plate Concrete Composite Foundation

The scaffolding foundation 5 is manually excavated to form a foundation pit 18 of 1×1×1 m, the fixed base 19 at the bottom of the steel pipe post is connected to the steel pole by welding using a 0.8×0.8 m steel plate with the thickness of 20 mm, and is driven into the foundation soil using four anchor rods 20 with the length of 3 m, wherein the anchor rods are anchored using twisted steel of φ32 and M30 cement mortar. Finally, concrete is poured in the foundation pit to complete the foundation construction of the scaffolding structure.

The invention claimed is:

1. A combined energy dissipation scaffolding structure for preventing falling rock hazards for high and steep sloped areas in a seismic region, comprising a top surface impact resistance system, a top surface support system, a scaffolding body structure, a mountain-side anchorage system, and an anchoring-type steel-plate concrete composite foundation, wherein the top surface impact resistance system comprises an upper-layer steel plate, a lower-layer steel plate and an impact resistance seismic-decrease layer, wherein the upper-layer steel plate is made of a corrugated steel plate, the lower-layer steel plate is made of a flat steel plate, the impact resistance seismic-decrease layer is filled between the upper-layer steel plate and the lower-layer steel plate, and the steel plates are connected using high-strength bolts; the upper-layer steel plate is made of a corrugated steel plate with the thickness of 10 mm, wave height of 55 mm and pitch of waves of 200 mm, the lower-layer steel plate is made of a flat steel plate with the thickness of 5 mm, the impact-resistance seismic-decrease layer with the thickness of 30 cm is filled between the upper-layer steel plate and the lower-layer steel plate, wherein the density thereof is greater than 23 kg/m$^3$, and an inter-row spacing of the high strength bolts is 2×2 m;

the top surface support system is composed of 3D stereographic steel frame systems formed by combination in a horizontal direction, a vertical direction, a slant direction and a longitudinal direction, and the top surface support system is welded with the top surface impact resistance system and the scaffolding body structure respectively;

the scaffolding body structure is composed of an I-shape steel cross beam and support steel-pipe posts at both sides, concrete is cast at a lower-middle part of each steel-pipe post to a height of at least ⅓-½ of the height of the steel-pipe post; an upper part of the mountain-side steel-pipe post of the scaffolding body structure is provided with an impact prevention steel plate, and the lower part thereof is provided with a movable steel plate; the I-shape steel cross beam is connected to the steel-pipe posts at both sides by an isolation bearing to cooperate with the impact resistance seismic-decrease layer in the top surface impact-resistance system to achieve the functions of seismic decrease and energy dissipation;

the mountain-side anchorage system is composed of a feet-lock anchor rod which is perpendicular to a rock mass joint structure plane; and the feet-lock anchor rod is connected to the top surface impact-resistance system and the scaffolding body structure respectively;

the anchoring-type steel-plate concrete composite foundation is manually or mechanically excavated to form a foundation pit depending on site geological and topographical conditions, and is connected to the scaffolding body structure by a fixed base, wherein the base is welded with the steel-pipe posts using a steel plate, and the steel plate is connected to a concrete foundation using an anchor rod to improve the bearing capacity of the structure.

2. The combined energy dissipation scaffolding structure of claim 1, wherein channel steel are erected between the top surface support system and the top surface impact-resistance system along a top surface slope and are spaced at 50 cm.

* * * * *